United States Patent [19]

Shimizu

[11] Patent Number: 5,020,653

[45] Date of Patent: Jun. 4, 1991

[54] DEVICE FOR DISCRIMINATING BETWEEN COINS

[75] Inventor: Kazuo Shimizu, Isesaki, Japan

[73] Assignee: Sanden Corporation, Japan

[21] Appl. No.: 319,292

[22] Filed: Mar. 6, 1989

[30] Foreign Application Priority Data

Mar. 4, 1988 [JP] Japan ..... 63-49874

[51] Int. Cl.[5] ..... G07D 5/08

[52] U.S. Cl. ..... 194/317

[58] Field of Search ..... 194/317, 318, 319

[56] References Cited

U.S. PATENT DOCUMENTS

| | | | |
|---|---|---|---|
| 3,916,922 | 11/1975 | Prumm . | |
| 3,918,564 | 11/1975 | Heiman et al. | 194/318 |
| 4,108,296 | 8/1978 | Hayashi et al. . | |
| 4,234,072 | 11/1980 | Prumm . | |
| 4,286,703 | 9/1981 | Schuller et al. | 194/317 |
| 4,334,604 | 6/1982 | Davies . | |
| 4,349,095 | 9/1982 | Davies . | |
| 4,601,380 | 7/1986 | Dean et al. | 194/318 |
| 4,625,851 | 12/1986 | Johnson et al. . | |
| 4,625,852 | 12/1986 | Hoormann | 194/317 |

FOREIGN PATENT DOCUMENTS

| | | |
|---|---|---|
| 0122732 | 3/1984 | European Pat. Off. . |
| 5243497 | 10/1975 | Japan . |
| 55-62350 | 5/1980 | Japan . |
| 61-237190 | 10/1986 | Japan . |
| 2068621 | 2/1980 | United Kingdom . |
| 2029953 | 3/1980 | United Kingdom . |

*Primary Examiner*—F. J. Bartuska

*Attorney, Agent, or Firm*—Banner, Birch, McKie & Beckett

[57] ABSTRACT

A coin discriminating device is provided which includes a circuit having a coin sensor and a capacitor connected to the coin sensor in parallel. The circuit is disposed adjacent to a passageway through which coins move in a certain direction. A direct voltage source is connected to the circuit to supply electric current through a switching element. A first responsive circuit is connected between the circuit and a switching element and responds to characteristic damped oscillations which occur in the circuit when the switching element is turned off. A passage detecting circuit is disposed adjacent to the circuit to detect the presence of a coin in the passageway. A second responsive circuit turns the switching element off in response to an output signal from the passage detector. The characteristic damped oscillations are processed and compared with stored signals for a match in order to distinguish one coin from another.

12 Claims, 2 Drawing Sheets

United States Patent Office

PTO - BOYERS, PA Duty Station

MISSING PAGE TEMPORARY NOTICE

PATENT # 5020653 FOR ISSUE DATE 6-4-91

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

DRAWING SHEET # 1

Data Conversion Operation

Boyers, Pa

DEVICE FOR DISCRIMINATING BETWEEN COINS

TECHNICAL FIELD

This invention relates to a coin discriminating device, and more particularly, to a coin discriminating device for discriminating between the type and nature of coins and between real and counterfeit coins.

BACKGROUND OF THE INVENTION

Mechanical coin discriminating devices are well known in the prior art. Such devices, however, are complicated in construction and are prone to erratic and unreliable operation. Though substantial improvements have been made in such devices over the years, their mechanical nature poses a severe limitation on their overall reliability and usefulness. One significant drawback to mechanical coin discriminating devices is that such devices cannot distinguish between real and counterfeit coins. Thus, substantial revenues are lost by vending machine operators due to the use of counterfeit coins by users.

An electromagnetic induction type coin discriminating device has been developed in order to overcome the problems of conventional coin discriminating devices mentioned above. One such device is disclosed in Japanese Patent Laid-Open Gazette No. 55-62350. This coin discriminating device has a coin sensor and circuitry for periodically activating the coin sensor. When a coin is positioned adjacent to the sensor coil, the device responds to a particular attenuation burst occurring on the sensor coil in order to sense the coin. The structure of the circuit, however, is complicated and thus the device is high in cost.

SUMMARY OF THE INVENTION

It is a primary object of this invention to provide a coin discriminating device which can discriminate between real and counterfeit coins without contacting the coin.

It is another object of this invention to provide a coin discriminating device which is simple and low in cost.

It is a further object of the present invention to provide a coin discriminating device which is reliable in operation and easy to use.

It is a still further object of the present invention to provide a coin discriminating device which can readily and reliably discriminate between various sizes of coins.

The above and other objects of the present invention are achieved by a device which includes a coin presence detector which detects the presence of a coin and provides a coin detector control signal to a control circuit. In response to the control signal, the control circuit energizes a coin type sensor circuit which produces a signal unique to the type and nature of the coin. This signal is compared with previously stored signals which correspond to the type and nature of coins approved for use by the attached, for example, vending machine. When a match is found, the coin is "accepted" and the control circuit provides a corresponding signal to the vending machine. The control circuit may be formed from a microprocessor which could also perform other control functions for the vending machine, including keeping track of the number and value of the coins inserted into the machine.

The coin presence detector is formed of a light source and a light source detector. When the light source beam is interrupted by the presence of a coin, the light source detector sends a control signal to the control circuit which causes the coin sensing circuit to be activated. The coin sensing circuit is formed of an electric coil and a parallel connected capacitor. When the coin passes through the magnetic field generated by the coil when the field is collapsing, a waveform of damped oscillations is generated which is unique to the particular coin. The waveform is then processed and compared with stored signals for a match. If a match is found, the coin is accepted and if no match is found the coin is rejected.

Further objects, features and other aspects of the present invention will be understood from the following detailed description of the preferred embodiments with reference to the attached drawings.

BRIEF DESCRIPTION OF THE DRAWINGS

FIG. 1 is a simplified schematic circuit diagram illustrating a coin discriminating device in accordance with the present invention.

FIG. 2 is a waveform diagram illustrating various waveforms which correspond to the oscillations created when objects made of various materials pass through an electromagnetic field.

DETAILED DESCRIPTION OF THE PREFERRED EMBODIMENTS

Figure 3:
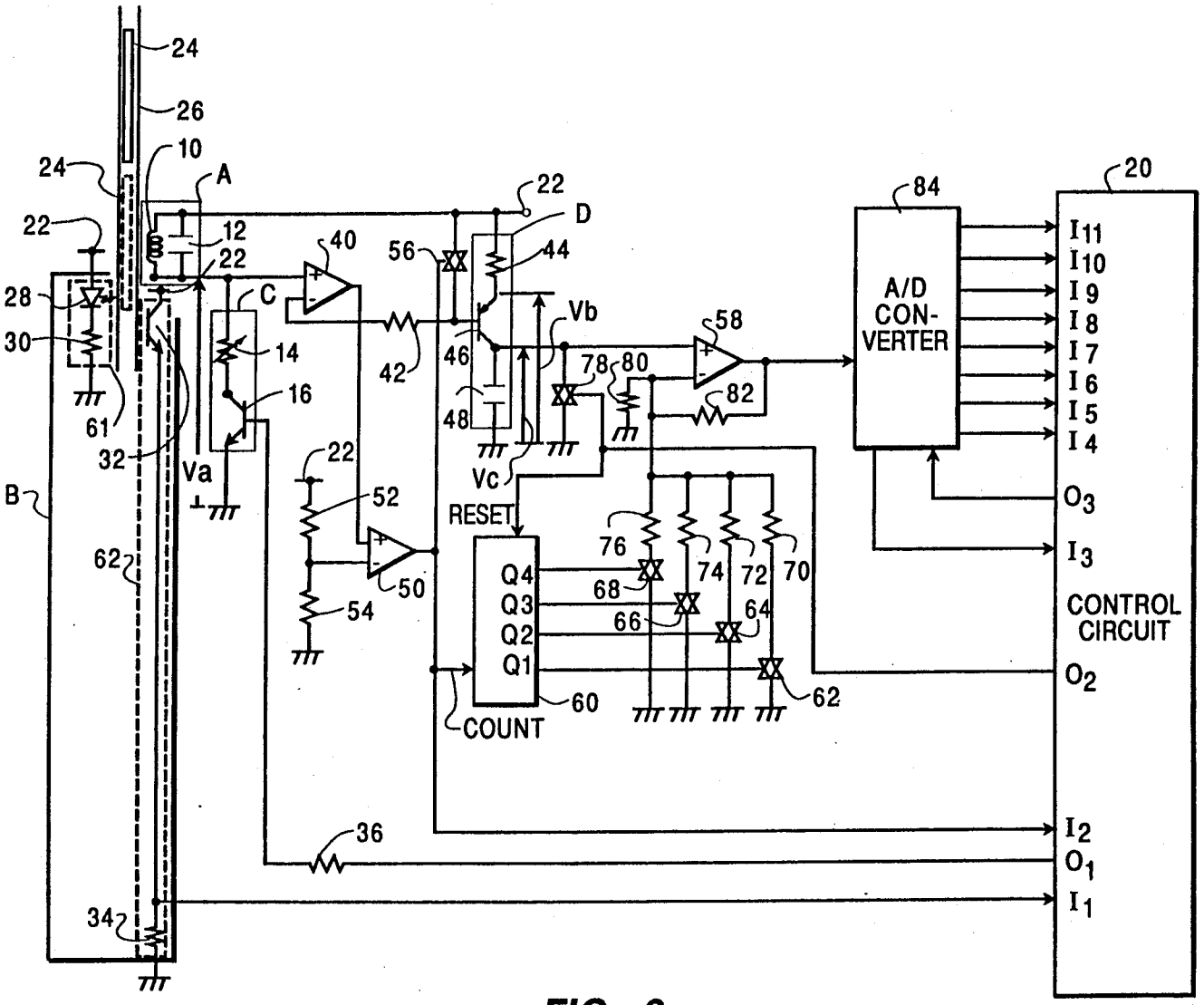
FIG. 3 is a more detailed schematic circuit diagram illustrating a coin discriminating device in accordance with the present invention.

Referring to FIG. 1, a schematic circuit diagram illustrating the operation of a coin discriminating device in accordance with the present invention will be described. The circuit includes a coin type sensing circuit formed of parallel connected sensor coil 10 and capacitor 12, variable resistor 14, switching element 16 and direct current power source 18, each of which are connected in serial arrangement. Sensor coil 10 has a resistance R and an inductance L and capacitor 12 has a capacitance C. Power source 18 provides direct current voltage E.

When switching element 16 is turned on, direct current from power source 18 flows through the circuit through variable resistor 14. If resistance R of sensor coil 10 is very small relative to the resistance of variable resistor 14, voltage Va between the negative terminal of power source 18 and node A at one end of variable resistor 14 nearly equals voltage E of power source 18, i.e., most of voltage E is dropped across variable resistor 14.

When switching element 16 is turned off, a series of damped oscillations will be developed at voltage Va due to the collapse of the magnetic field produced by sensor coil 10 when switch 16 was closed and the resistance to change in voltage across the coil caused by capacitor 12. As will be discussed below, FIG. 2 illustrates several series of such damped oscillations. Voltage Va during the series of damped oscillations is given by the following equation:

$$Va = E + \frac{\sqrt{a^2 + b^2}}{b} * E * e^{-at} \sin(bt)$$

wherein:

a is a damping factor for the damped oscillations;

b is the angular frequency for the damped oscillation;

e is a predetermined value; and t is the elapsed time after switching element 16 is turned off.

Damping factor a and angular frequency b are given by the following equations:

$$a = \frac{R}{2L}, \; b = \sqrt{\frac{1}{CL} - a^2}$$

wherein C is capacitance and L is inductance.

If a conductive object crosses the electromagnetic field of sensor coil 10, electromagnetic mutual action occurs and an eddy current is generated inside the conductive object. Accordingly, the impedance, i.e., resistance R and inductance L, of sensor coil 10 is caused to vary.

When a non-magnetic conductive object passes through the electromagnetic field of coil 10, resistance R of sensor coil 10 increases and inductance L of sensor coil 10 reduces. The higher the conductivity of the non-magnetic conductive object, the less resistance R increases and the more inductance L decreases. Therefore, the damped oscillations which are generated by sensor coil 10 and capacitor 12, vary with respect to amplitude and frequency in accordance with the electrical characteristics, i.e., magnetism and conductivity, of the object within the electromagnetic field of sensor coil 10.

FIG. 2 illustrates the waveform of damped oscillations from objects which are made of various materials in an electromagnetic field. Waveform a represents oscillations in the absence of an object in the magnetic field. Waveforms b, c and d represent the waveforms of damped oscillations from objects made of copper, brass and stainless steel, respectively.

As the waveform of damped oscillations varies according to the eddy current which occurs inside the object, it also varies according to the configuration of the object which limits the flow of eddy current, i.e., outer diameter, pattern and thickness.

Since a coin is made of non-magnetic conductive materials, the generated damped oscillations have a unique shape when the coin passes through the electromagnetic field of sensor coil 10. Thus, the type and nature of a coin may be determined by inspecting the generated voltage waveform of the damped oscillations.

Referring to FIG. 3, there is shown a coin discriminating device in accordance with an embodiment of the present invention. Control circuit 20 controls the operation of the device and may be formed of a microcomputer. A coin type sensing circuit is formed of a parallel connected sensor coil 10 and capacitor 12. One end of coin type sensing circuit A is connected to positive terminal 22 of a power source and the other end is coupled to ground through variable resistor 14 and switching transistor 16. Sensor coil 10 is positioned adjacent to passageway 26 through which coin 24 passes.

Coin presence detecting circuit B detects the presence of coin 24 and is formed of light source b1 disposed adjacent to sensor coil 10 and light sensor b2. Light source b1 is disposed to one side of passageway 26 and includes light emitting diode 28 and resistor 30. Light sensor b2 is disposed on the other side of passageway 26 and includes phototransistor 32 and resistor 34. The output terminal of light sensor b2 is connected to an input terminal I1 of control circuit 20. The output signal from light sensor b2 is a logic high level H when coin 24 is not adjacent sensor coil 10 and a logic low level L when coin 24 is adjacent sensor coil 10. Thus, when coin 24 is positioned as shown by the dotted line in FIG. 3, the light radiated by diode 28 is obstructed by coin 24 and does not reach phototransistor 32. The output signal from light sensor b2, therefore, is a logic low level L.

Switching circuit C includes variable resistor 14 and transistor 16 which are connected to coin type sensing circuit A which includes sensor coil 10 and capacitor 12. When switching circuit C is closed and then opened, coin sensing circuit A is caused to produce a waveform of damped oscillations. The base of transistor 16 is coupled to output terminal O1 of control circuit 20 through resistor 36. When the output signal from output terminal O1 of control circuit 20 is a logic high level H, transistor 16 is turned on and direct current passes to sensing circuit A through variable resistor 14. When the output signal from terminal O1 is switched from a logic high level H to logic low level L, transistor 16 is turned off and a series of damped oscillations are generated by coin type sensing circuit A. Variable resistor 14 is provided to adjust the level of current flow which is supplied to coin type sensing circuit A, and thus establishes the starting relative amplitude of the oscillations.

Control circuit 20 provides switching circuit C with a high logic level output signal from output terminal O1 when control circuit 20 receives a high level output signal from light sensor b2. Thus, electric current is supplied to coin sensing circuit A. Likewise, control circuit 20 provides switching circuit C with a low level output signal from output terminal O1 when control circuit 20 receives a low level output signal from sensor light b2. Thus, the current flow to coin type sensing circuit A is interrupted and a series of damped oscillations are generated.

The output end of coin sensing circuit A is connected to the positive input terminal of impedance converted 40. The negative input terminal of impedance converter 40 is coupled through resistor 42 to integrating circuit D which includes resistor 44, transistor 46 and capacitor 48. The output terminal of impedance converter 40 is connected to the positive input terminal of voltage comparator 50. The negative input terminal of voltage comparator 50 is coupled to ground through resistor 54. Resistor 54 is coupled to power source 22 through resistor 52. Accordingly, a reference voltage M provided from power source 22 by voltage divider resistors 52 and 54 is provided to the negative input terminal of voltage comparator 50 and is given by the following equation:

$$M = \frac{R2}{R1 + R2} \times E$$

wherein R1 is the resistance of resistor 52, R2 is the resistance of resistor 54 and E is power source voltage 22.

When the output signal of impedance converter 40 is greater than R2/R1+R2*E (voltage M), the output signal of voltage comparator 50 is a high logic level H. The output terminal of voltage comparator 50 is connected to a control terminal of analog switch 56. Analog switch 56 connects the power source 22 end of resistor 44 to the base of transistor 46. When the high level output signal H from voltage comparator 50 is provided to the control terminal of analog switch 56, the impedance between its input and output terminals is reduced to zero, i.e., switch 56 is turned on. Accordingly, while the output signal of impedance converter 40 is greater than voltage M, the voltage on the base of transistor 46 in integration circuit D is set to the level of voltage source 22 and integration circuit D does not perform an integrating function. Correspondingly, while the output signal from impedance converter 40 is less than voltage M, the output signal of voltage comparator 50 is at a logic low level L and the impedance between the input and output terminals of analog switch 56 is maximum, i.e., the switch is opened. Thus, integration circuit D starts to perform an integrating function. That is, voltage Vb is generated between the emitter terminal of transistor 46 in integration circuit D and ground in accordance with the output voltage of impedance converter 40. Thus, current (E−Vb)/R3, where R3 is the resistance of resistor 44, charges capacitor 48. Thus, integration circuit D integrates the oscillations less than voltage M in the waveform of the damped oscillations which are generated by coin type sensing circuit A.

The output terminal of voltage comparator 50 also is connected to a count terminal of pulse number detecting circuit 60 which is formed of a binary counter. The output signal from voltage comparator 50 is a series of pulses equal to the number of the oscillations less than voltage M in damped oscillations which are generated by coin sensing circuit A. Pulse number detecting circuit 60 counts the number of pulses and outputs the pulse count at its outputs Q1–Q4. For instance, when the number of a pulses at output of voltage comparator 50 is one, pulse number detecting circuit 60 outputs a high level output signal H from only output terminal Q1. Likewise, when the number of pulses is two, three or four, pulse number detecting circuit 60 outputs a high level output signal H from output terminal Q2, Q3 or Q4, respectively.

Output terminals Q1, Q2, Q3 and Q4 of pulse number detecting circuit 60 are connected to control terminals of analog switches 62, 64, 66 and 68, respectively. Each of analog switches 62, 64, 66 and 68 is coupled to ground at one end and the negative input terminal of amplifier 58 at the other end through resistors 70, 72, 74 and 76. If the high level output signal H from pulse number detecting circuit 60 is supplied to the control terminal of one of analog switches 62, 64, 66 and 68, the impedance between the input and output terminals of the analog switch which received the signal is reduce to zero. Accordingly, amplifier 58 receives the output signal from only the selected analog switch.

The output terminal of voltage comparator 50 is connected to input terminal I2 of control circuit 20. Output terminal O2 of control circuit 20 is connected to a reset terminal of pulse number detecting circuit 60 and to the control terminal of analog switch 78 which is connected to the positive input terminal of amplifier 58 in parallel with capacitor 48. Control circuit 20 calculates the number of pulses from the output terminal of voltage comparator 50. If voltage comparator 50 does not provide any pulses for a predetermined time, control circuit 20 assumes that the waveform of damped oscillations has been reduced until integration circuit D cannot be operated and changes the output signal from output terminal O2 of control circuit 20 to a high logic level H for a predetermined time after a time delay. Accordingly, pulse member detecting circuit 60 is reset and capacitor 48 is discharged. The output voltage VC of condenser 48 is thus zero.

The negative input terminal of amplifier 58 is connected to ground through resistor 80. The amplification factor of amplifier 58 is determined by the parallel resistor network formed of resistors 70, 72, 74 and 76 and resistors 80 and 82 connected between the output terminal and the negative input terminal of amplifier 82. Accordingly, the amplification factor of amplifier 58 is varied in accordance with the number of pulses from the output of voltage comparator 50. In cases where the number of pulses from the output of voltage comparator 50 is greater than four and the output signal from output terminals Q1, Q2, Q3 and Q4 is a low logic level L, the amplification factor of amplifier 58 is determined in accordance with the ratio of the resistance of resistor 80 to the resistance of resistor 82.

The output terminal of amplifier 58 is connected to the input terminal of A/D converter 84. A/D converter 84 changes the voltage at its input terminal into a digital value in response to a conversion start control signal from output terminal O3 of control circuit 20. If voltage comparator 50 does not provide any pulses for a predetermined time, control circuit 20 outputs the control signal from output terminal O3 to A/D converter 84. If A/D converter 84 completes the conversion of the output voltage from amplifier 58 into a digital value, A/D converter 84 outputs a conversion finish signal to input terminal I3 of control circuit 20. In response to the conversion finish signal, circuit 20 inputs the digital value from A/D converter 84.

Control circuit 20 also determines whether the digital value, which is received at its input terminal I4–I11, and the counter value, which is received at its input terminal I2, are consistent with a predetermined value corresponding to a particular coin. Thus, the coin discriminating device of the present invention permits coins to be distinguished reliably and at low cost. Since each coin produces a unique series of damped oscillations, the device of the invention permits accurate discrimination between coins as to type and nature.

This invention has been described in detail in connection with a preferred embodiment, but this embodiment is an example only and the invention is not restricted thereto. It will be easily understood, by those skilled in the art that other variation and modifications can be easily made within the scope of the appended claims.

I claim:

1. A coin discriminating device, said device comprising:

coin pressure detecting means for sensing the presence of a coin and providing a corresponding presence signal;

coin sensing means for generating sensing data corresponding to the type of coin;

control means coupled to said coin presence detecting means and to said coin sensing means for controlling the operation of said coin presence detecting means and said coin sensing means, said control means comparing said sensing data with stored data in order to discriminate a first coin from a second coin; and an impedance matching device and an integrating device, said sensing data being coupled to a first input of said impedance matching device and the output of said integrating device being coupled to a second input of said impedance matching device, wherein said sensing data is in the form of a series of damped voltage oscillations, the amplitude and frequency of said oscillations being unique for each particular type of coin.

2. The device of claim 1 wherein said coin presence detecting means is formed of a light source and a light source detector, wherein said light source detector providing said presence signal.

3. The device of claim 2 wherein said light source is a light emitting diode and said light source detector is a phototransistor.

4. The device of claim 1 further including switch means for activating said coin sensing means, said switch means being coupled between said coin sensing means and said control means, said control means controlling the operation of said switch means to activate said coin sensing means at predetermined times.

5. The device of claim 4 wherein in response to said presence signal said control means operates said switching means to activate said coin sensing means.

6. The device of claim 5, wherein said coin sensing means remains activated for the duration of said presence signal.

7. The device of claim 4 wherein said switching means includes a switching transistor.

8. The device of claim 1 wherein said coin sensing means is formed of an electric coil and a capacitor connected in parallel.

9. The device of claim 1 further including voltage comparison means for comparing the output of said impedance matching device to a reference voltage signal, the output of said voltage comparison means being a series of pulses indicative of the number of said damped oscillations.

10. The device of claim 9 further including amplifier means for amplifying said integrating voltage to provide an amplified integrating voltage.

11. The device of claim 10 further including A/D converter means for converting said integrated voltage to a digital signal, said digital signal being provided to said control mean.

12. The device of claim 10 further including counter means coupled to the output of said voltage comparison means for counting the pulses output by said voltage comparison means, the output of said counter means being used to control the amplification factor of said amplifier.

* * * * *